US009581417B2

(12) United States Patent
Tseng

(10) Patent No.: US 9,581,417 B2
(45) Date of Patent: Feb. 28, 2017

(54) CONCEALED NET THROWING DEVICE

(71) Applicant: Jui-Fu Tseng, Yilan (TW)

(72) Inventor: Jui-Fu Tseng, Yilan (TW)

( * ) Notice: Subject to any disclaimer, the term of this patent is extended or adjusted under 35 U.S.C. 154(b) by 0 days.

(21) Appl. No.: 15/136,576

(22) Filed: Apr. 22, 2016

(65) Prior Publication Data

US 2016/0238350 A1 Aug. 18, 2016

(51) Int. Cl.

| | |
|---|---|
| ***F41B 11/00*** | (2013.01) |
| ***F41H 13/00*** | (2006.01) |
| ***F41B 11/80*** | (2013.01) |
| *F41C 9/02* | (2006.01) |

(52) U.S. Cl.

CPC ..... *F41H 13/0006* (2013.01); *F41B 11/80* (2013.01); *F41C 9/02* (2013.01)

(58) Field of Classification Search

CPC ..... F41H 13/0006; F41B 11/62; F41B 11/80; F41C 9/00; F41C 9/02

See application file for complete search history.

(56) References Cited

U.S. PATENT DOCUMENTS 8,857,305 B1 * 10/2014 Tseng ..... F41B 11/80 124/71
9,157,694 B1 * 10/2015 Tseng ..... F41B 11/62
2011/0005373 A1 * 1/2011 Martinez ..... B63G 9/04 89/1.34
2012/0192707 A1 * 8/2012 Rogers ..... F41H 13/0006 89/36.08
2014/0334058 A1 * 11/2014 Galvan ..... F41H 13/0025 361/232
2015/0168107 A1 6/2015 Tseng

FOREIGN PATENT DOCUMENTS

DE 4437412 A1 * 9/1995 ..... F41B 11/62
DE EP 0872705 A2 * 10/1998 ..... B63G 7/02
JP WO 2005008009 A1 * 1/2005 ..... E05G 5/02

* cited by examiner

*Primary Examiner* — Gabriel Klein

(57) ABSTRACT

A net throwing device is disguised as a security camera and includes a casing including a front chamber, inclined tubes around the front chamber, a rear inner tube having an aperture member, and a rear outer tube having an aperture element; an air canister fastened in the inner tube; a spring biased piercing member slidably disposed between the front chamber and the air canister; a spring biased lock pin in the piercing member and having an end disposed in the aperture member to lock the piercing member in a locked position; a spring biased rod member through the aperture element; a cam member engaging the rod member; an external antenna; a receiver; a processor electrically connected to the receiver; an electric motor electrically connected to the processor; and a net received in the front chamber and including edge weights in the tubes respectively.

1 Claim, 8 Drawing Sheets

CONCEALED NET THROWING DEVICE

BACKGROUND OF THE INVENTION

1. Field of the Invention

The invention relates to restraint devices and more particularly to a net throwing device disguised as a security camera.

2. Description of Related Art

US Publication No. 201 5/01 681 07 to Tseng discloses a net throwing device for use in combination with a compressed air powered launching device, comprising a pod comprising an axial space, tubes around the axial space, and a slot formed on an edge; a net in the axial space; weights each in one of the tubes; and a casing comprising a forward oriented projection on an edge of a front end, the forward oriented projection being fitted in the slot to secure the casing and the pod together, and a protrusion adjacent to the forward oriented projection; wherein at least one of the tubes is inclined with respect to an axis of the axial space, and at least one of the tubes is parallel to the axis of the axial space; and wherein the casing communicates with the axial space.

The drawback of the prior art is that it is not concealed. Thus a robber may easily find it and try not to be caught by it. As a result, the desired function of snarling the robber is compromised.

Thus, the need for improvement still exists.

SUMMARY OF THE INVENTION

It is therefore one object of the invention to provide a net throwing device comprising a casing including a front chamber, a plurality of inclined tubes disposed around mouth of the front chamber, an inner tube disposed rearward of the front chamber and having an aperture member, an outer tube disposed rearward of the front chamber with the inner tube disposed therein, the outer tube having an aperture element, and a rear cap threadedly secured to a rear end of the outer tube; an air canister for containing compressed air fastened in the inner tube; a spring biased piercing member slidably disposed between the front chamber and the air canister; a spring biased lock pin disposed in the piercing member and having an end disposed in the aperture member to lock the piercing member in a locked position; a spring biased rod member disposed through the aperture element; a cam member engaging the rod member; an antenna disposed externally of the casing; a receiver disposed in the casing and connected to the antenna; a processor electrically connected to the receiver; an electric motor electrically connected to the processor; and a net received in the front chamber and including a plurality of weights at an edge, the weights being disposed in the tubes respectively; wherein in response to receiving infrared (IR) light pulses by the receiver via the antenna, and receiving a digital signal representing the IR light pulses by the processor, the processor activates the electric motor which in turn rotates the cam member, the rod member is depressed by the cam member, the lock pin is pressed by the rod member to clear the aperture member, the piercing member is unlocked to push toward and pierce a mouth of the air canister, the pierced air canister is configured to release compressed air, and the compressed air flows to the tubes to push the weights out of the tubes, thereby launching the net.

The above and other objects, features and advantages of the invention will become apparent from the following detailed description taken with the accompanying drawings.

DETAILED DESCRIPTION OF THE INVENTION

Figure 1:
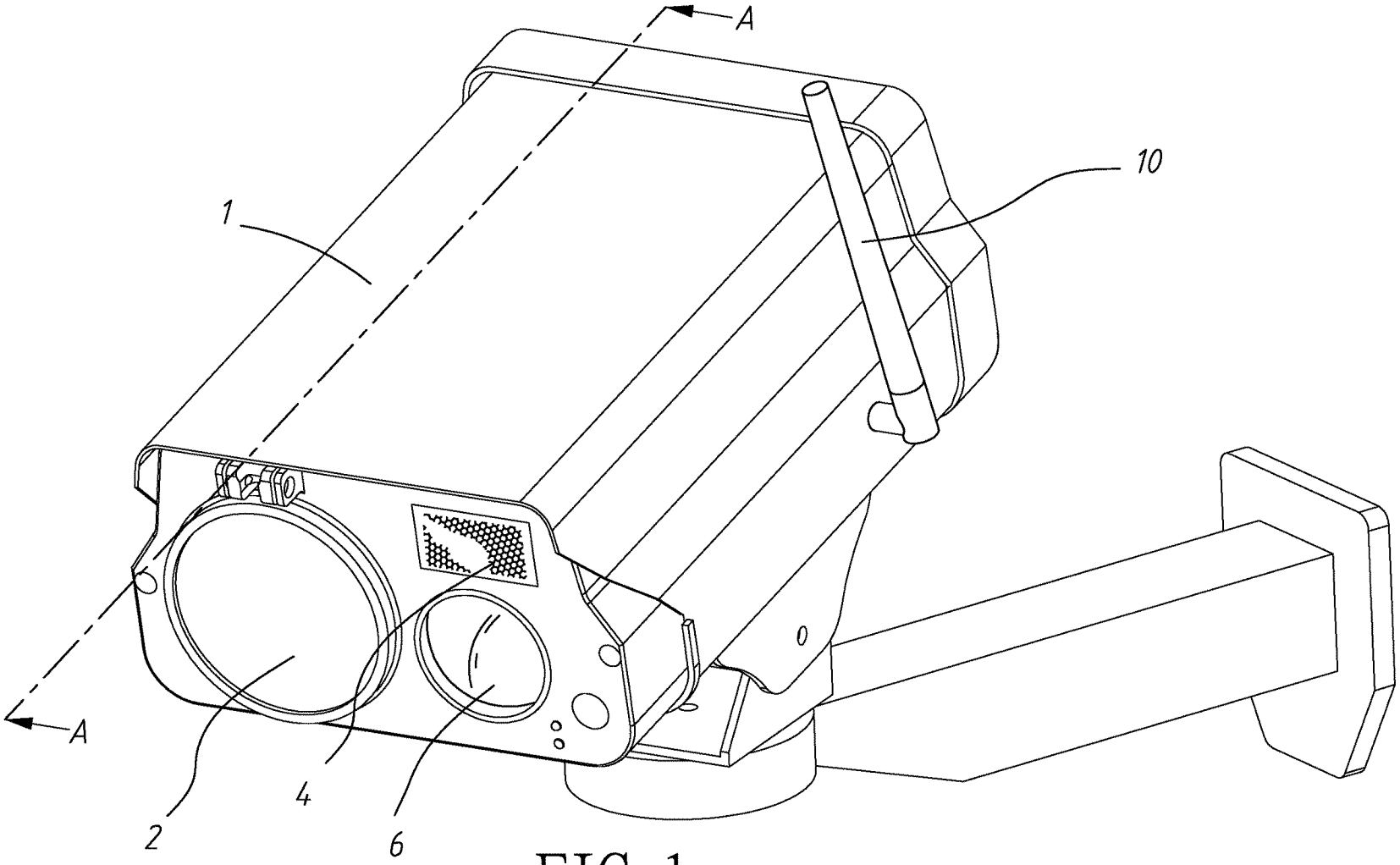
FIG. 1 is a perspective view of a concealed net throwing device according to a first preferred embodiment of the invention.
Figure 2:
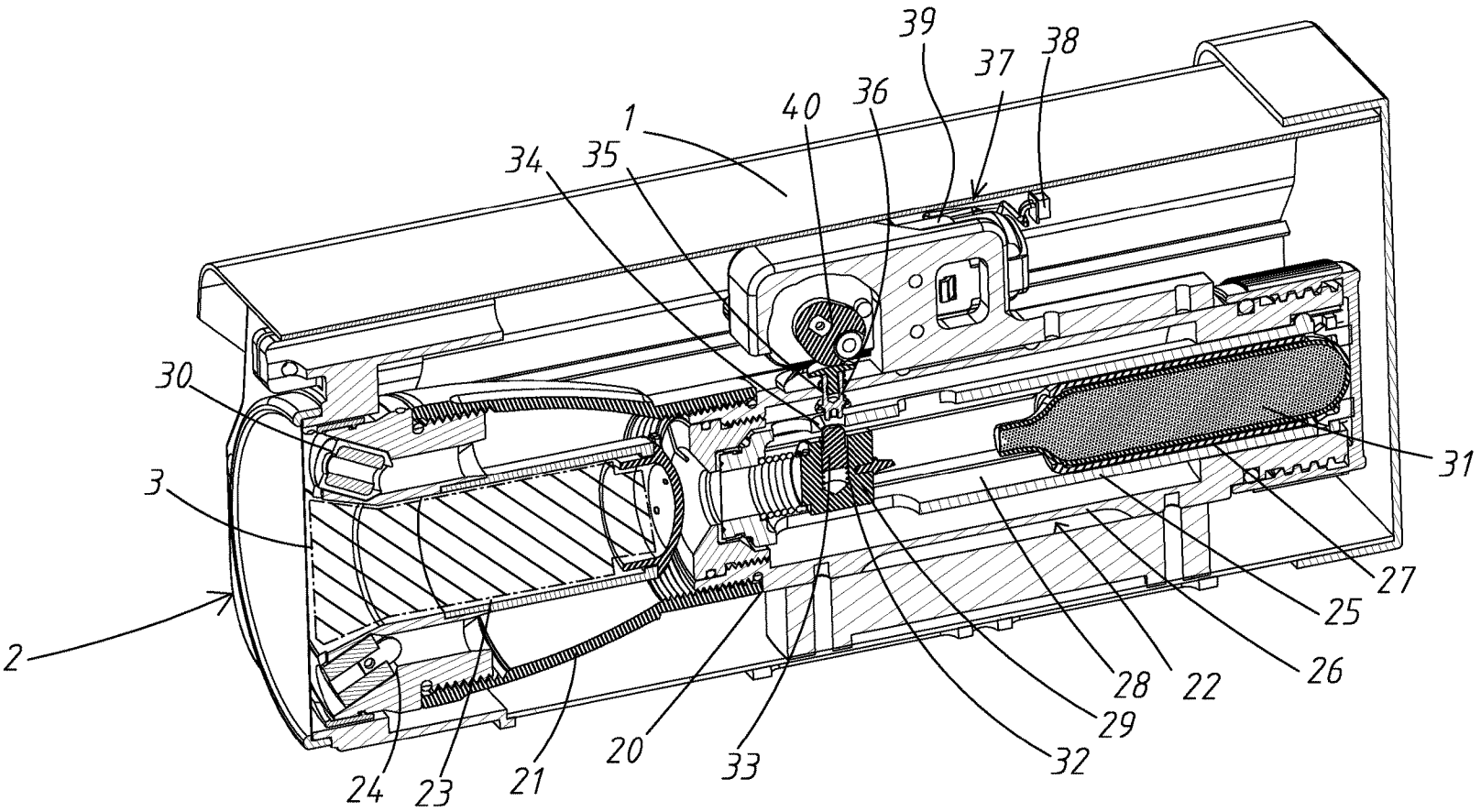
FIG. 2 is a sectional view taken along line A-A of FIG. 1.
Figure 4:
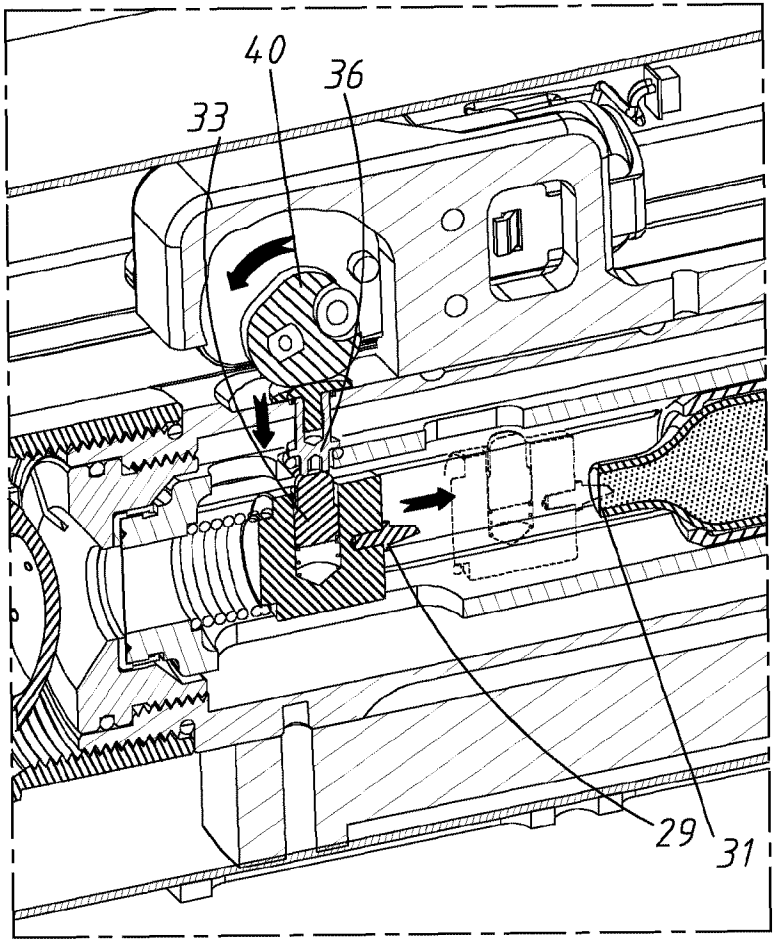
FIG. 4 is a view similar to FIG. 3 showing the launching mechanism being operated.
Figure 3:
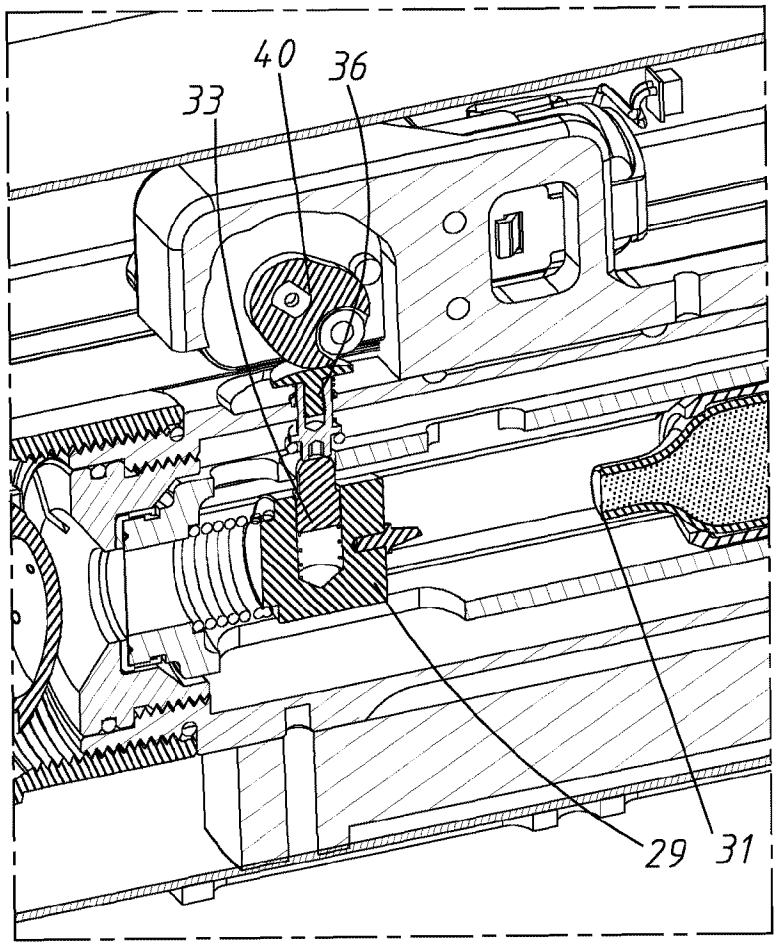
FIG. 3 is an enlarged view of the intermediate portion of FIG. 2 where the launching mechanism is not operated.
Figure 5:
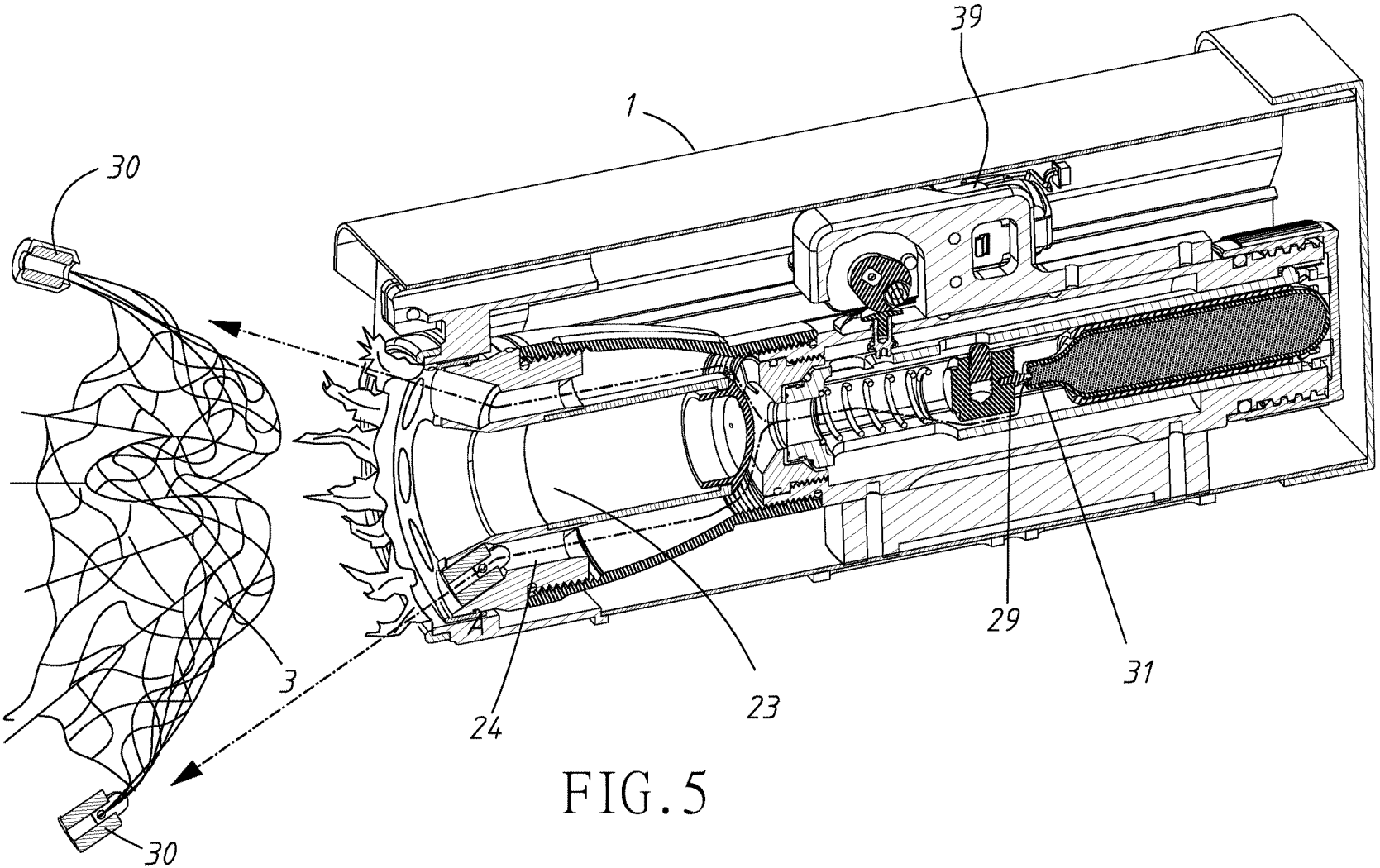
FIG. 5 is a view similar to FIG. 2 showing a net having been launched by activating the launching mechanism.

Referring to FIGS. 1 to 8, a net throwing device in accordance with a first preferred embodiment of the invention is shown as a wall mounted, swiveled one and disguised as a security camera. The net throwing device comprises the following components as discussed in detail below.

A casing 1 comprises a launching mechanism 2 including a barrel member 20 having a front section 21 and a rear section 22 threadedly secured to the front section 21. A chamber 23 is provided in the front section 21 for receipt of a net 3. A plurality of inclined tubes 24 are formed around the mouth of the front section 21. A plurality of weights 30 are disposed in the tubes 24 respectively. The weight 30 is connected to the net 3 by a plurality of threads at the edge of the net 3. The rear section 22 is formed as an outer tube 26 with an inner tube 25 disposed therein. A rear cap 27 is threadedly secured to a rear end of the outer tube 26. An air canister 31 is fastened in the inner tube 25 and has a rear end urging against a blind bottom of the rear cap 27. A front portion of the inner tube 25 is formed as a space 28 in front of the mouth of the air canister 31. A spring biased piercing member 29 is slidably provided at a front end of the space 28 and has its pointed end facing the mouth of the air canister 31. A receptacle 32 is provided in the piercing member 29. A spring biased lock pin 33 is provided in the receptacle 32 and has an end disposed in an aperture 34 through the inner tube 25 in a locked position, i.e., the piercing member 29 being locked. A spring biased rod member 36 is disposed through an aperture 35 which is through the outer tube 26. A cam member 40 is provided to press the rod member 36. A receiver 38 is provided in the casing 1 and externally of the barrel member 20. An antenna 10 is provided externally of the casing 1 and connected to the receiver 38. A processor 37 is electrically connected to the receiver 38 and an electric motor 39 respectively. In response to receiving infrared (IR) light pulses by the receiver 38 via the antenna 10 and receiving a digital signal representing the IR light pulses by the processor 37, the processor 37 activates the electric motor 39 which in turn rotates the cam member 40. Next, the rod member 36 is depressed by the cam member 40. And in turn, the lock pin 33 is pressed to clear the aperture 34. Thus, the piercing member 29 is unlocked. The piercing member 29 is pushed toward the mouth of the air canister 31 due to exertion of its elastic force. Next, the mouth of the air canister 31 is pierced to release compressed air therefrom. The compressed air flows to the tubes 24 via the barrel member 20. And in turn, the weights 30 are pushed out of the tubes 24. Finally, the net 3 is launched from the launching mechanism 2. A theft or robber can be suddenly snarled by the net 3.

Figure 6:
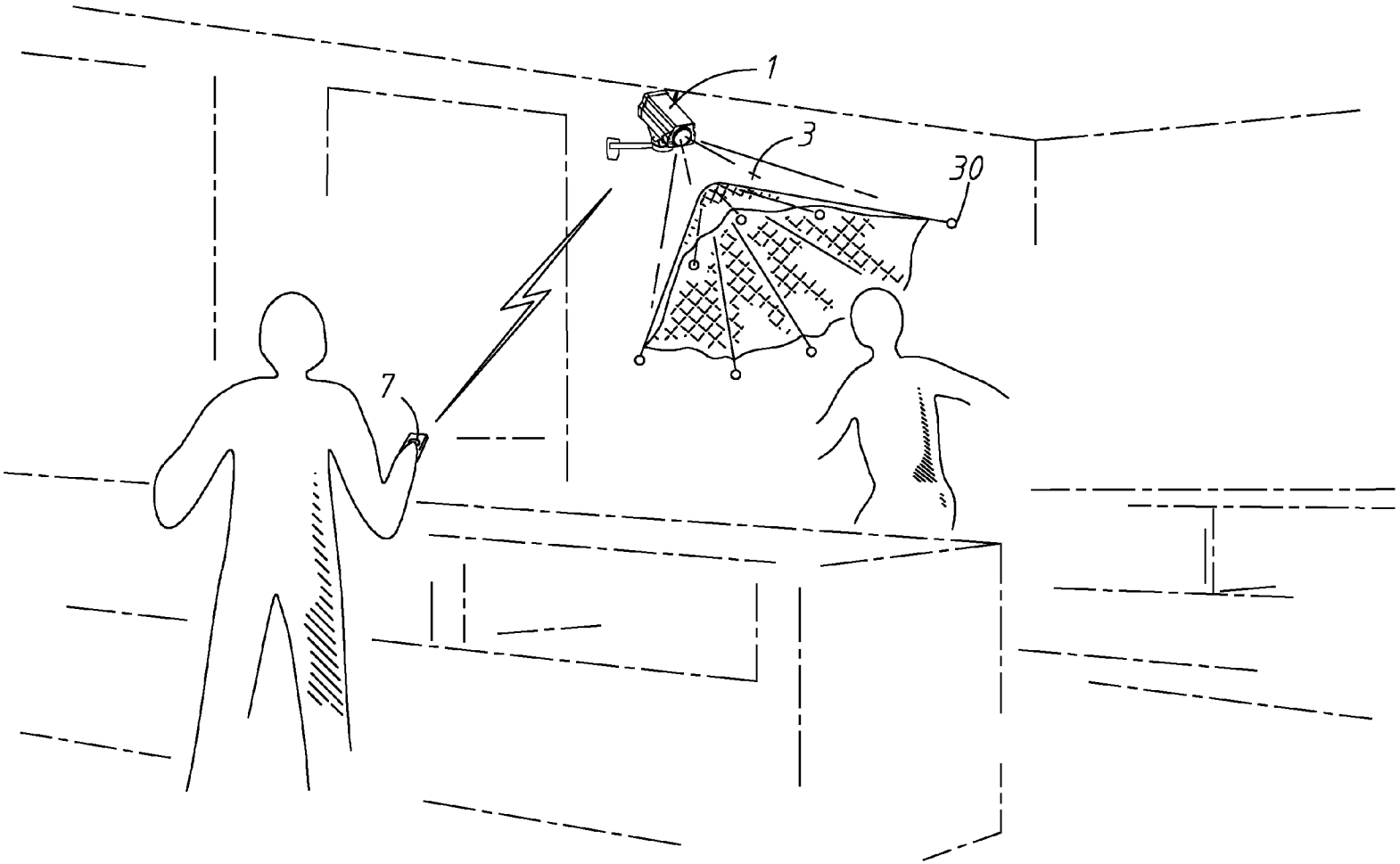
FIG. 6 schematically depicts a robber to be snarled by the net launched from the net throwing device after being activated by a shop employee using a remote control.

As shown in FIG. 6 specifically, a shop employee presses a button on a remote control 7 to activate the net throwing device by transmitting IR light pulses to the receiver 38 via the antenna 10. Finally, the net 3 is launched to snarl a robber.

Figure 7:
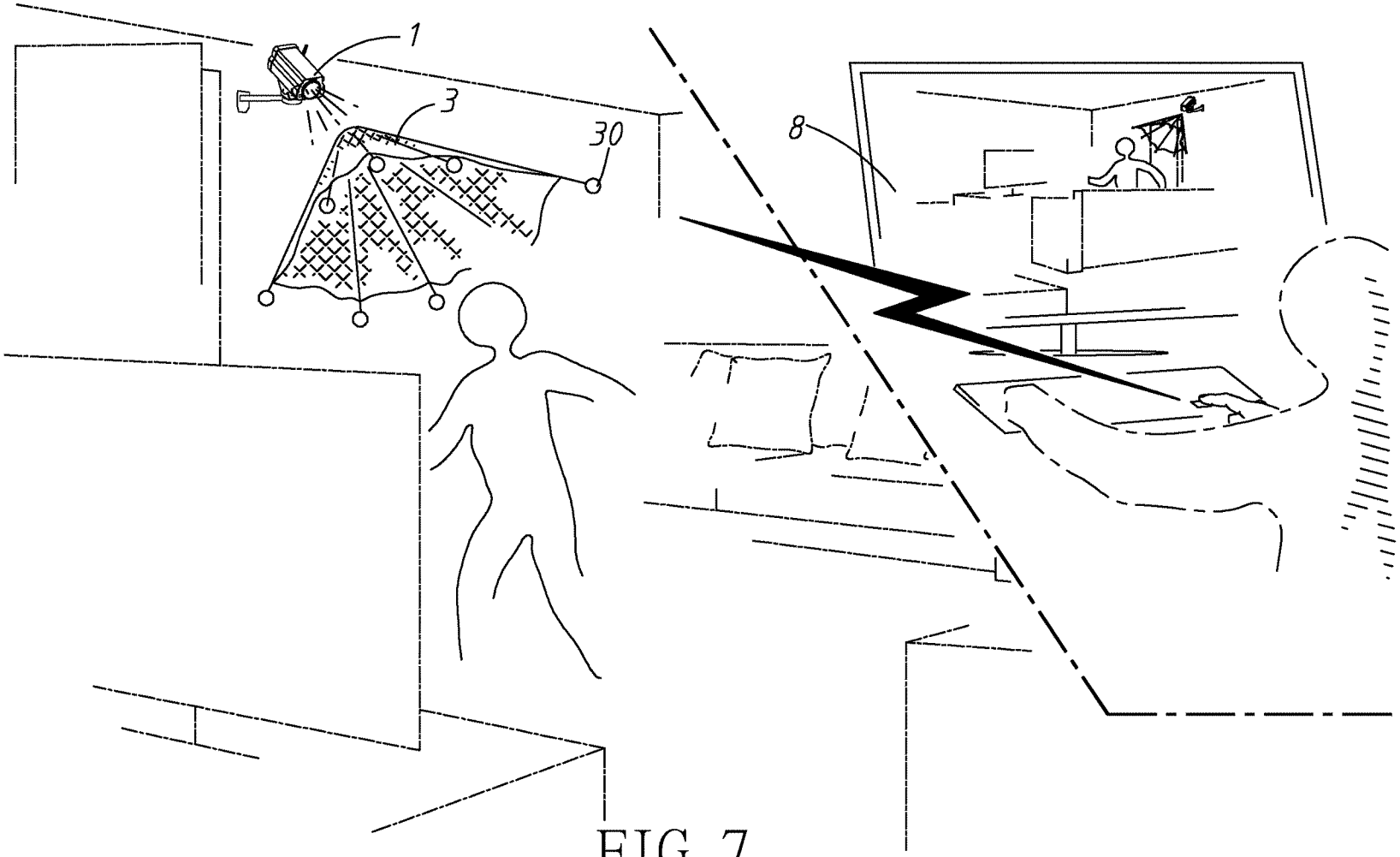
FIG. 7 schematically depicts a robber to be snarled by the net launched from the net throwing device after being activated by a security personnel operating a console in a control room.

As shown in FIG. 7 specifically, an employee in a control room 8 presses a key to activate the net throwing device which in turn launches the net 3 to snarl a robber.

Figure 8:
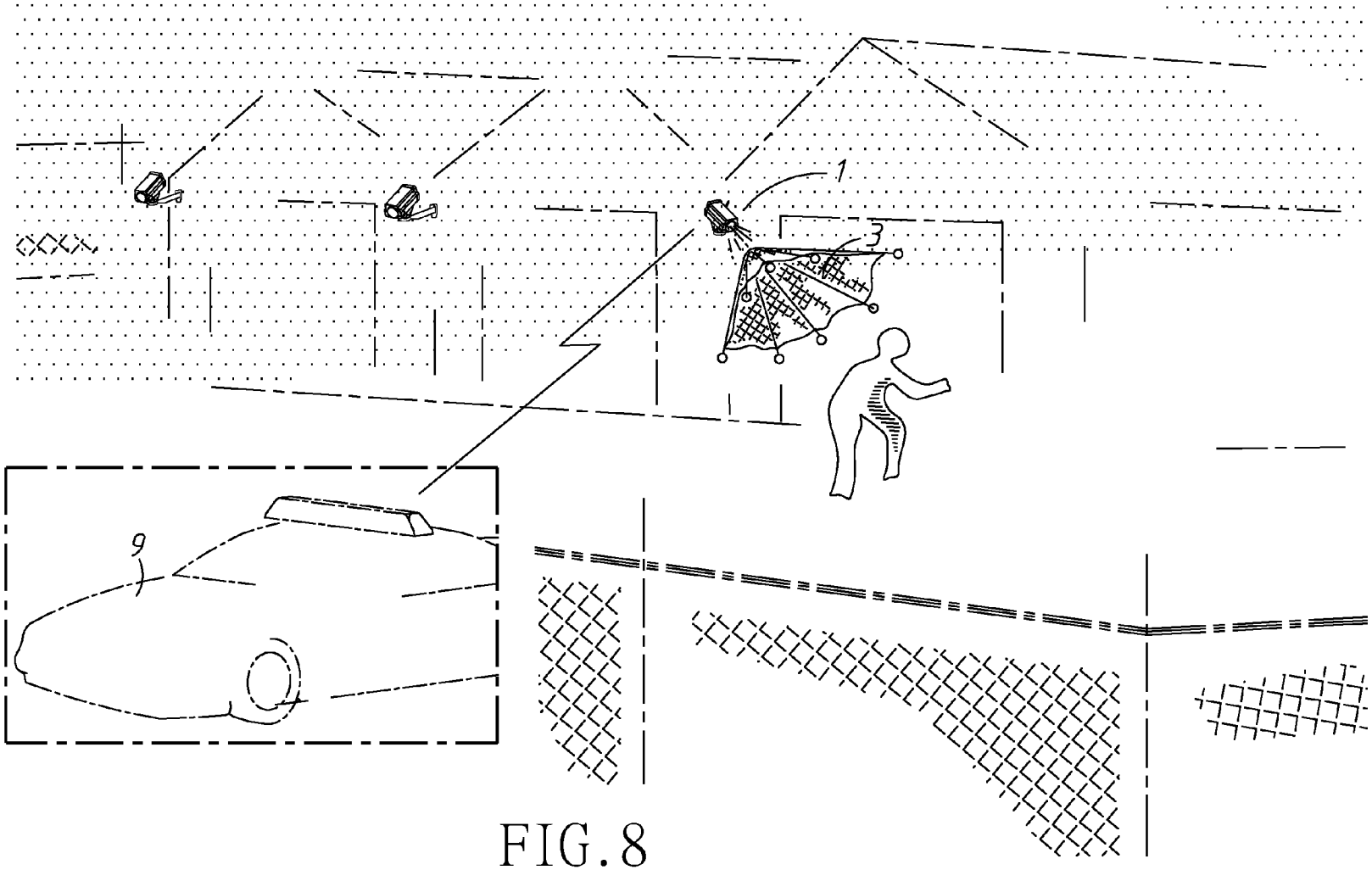
FIG. 8 schematically depicts a robber to be snarled by the net launched from the net throwing device after being activated by a shop employee who also informs nearby police in a police car using a telephone.

As shown in FIG. 8 specifically, a home owner may activate the net throwing device which in turn launches the net 3 to snarl a theft and inform a police officer in a police car at the same time. Thus, the police may quickly arrive at the scene to catch the theft.

As shown in FIG. 1 specifically, a digital camera 6 and an IR sensor 4 are provided adjacent to the launching mechanism 2. The digital camera 6 aims at disguising the net throwing device as a security camera and the IR sensor 4 can sense the presence of any unlawful individuals within a predetermined distance.

Figure 9:
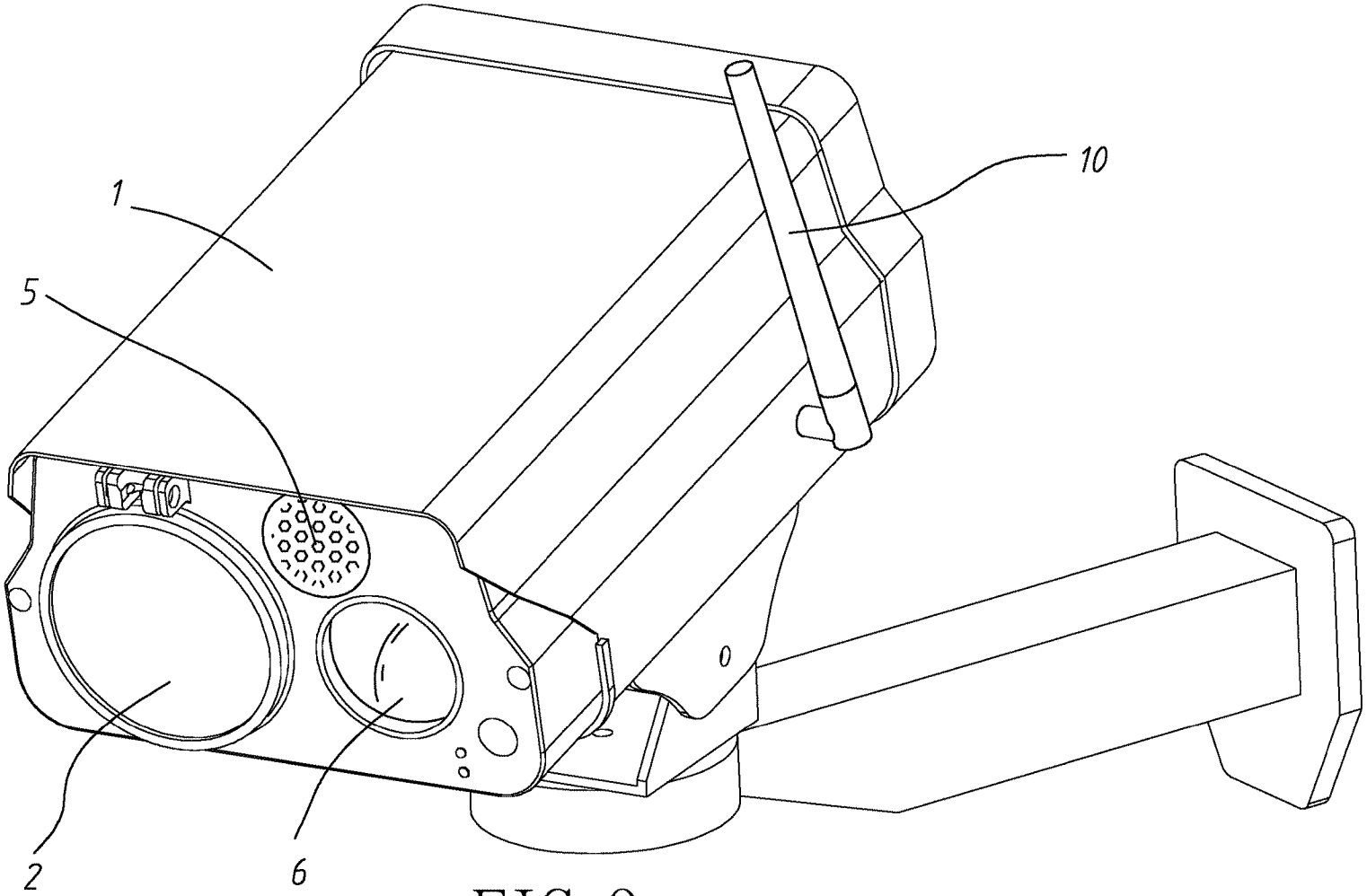
FIG. 9 is a perspective view of a concealed net throwing device according to a second preferred embodiment of the invention.

Referring to FIG. 9, a concealed net throwing device in accordance with a second preferred embodiment of the invention is shown. The characteristics of the second preferred embodiment are substantially the same as that of the first preferred embodiment except the following: The IR detector is replaced by an alarm 5.

While the invention has been described in terms of preferred embodiments, those skilled in the art will recognize that the invention can be practiced with modifications within the spirit and scope of the appended claims.

What is claimed is:

1. A net throwing device comprising:

a casing including a front chamber, a plurality of inclined tubes disposed around a front end of the front chamber, an inner tube disposed rearward of the front chamber and having an aperture member, an outer tube disposed rearward of the front chamber with the inner tube disposed therein, the outer tube having an aperture element, and a rear cap threadedly secured to a rear end of the outer tube;

an air canister for containing compressed air fastened in the inner tube;

a spring biased piercing member slidably disposed between the front chamber and the air canister;

a spring biased lock pin disposed in the piercing member and having an end disposed in the aperture member to lock the piercing member;

a spring biased rod member disposed through the aperture element;

a cam member engaging the rod member;

an antenna disposed externally of the casing;

a receiver disposed in the casing and connected to the antenna;

a processor electrically connected to the receiver;

an electric motor electrically connected to the processor; and a net received in the front chamber and including a plurality of weights at an edge, the weights being disposed in the inclined tubes respectively;

wherein in response to receiving infrared (IR) light pulses by the receiver via the antenna, and receiving a digital signal representing the IR light pulses by the processor, the processor activates the electric motor which in turn rotates the cam member, the rod member is depressed by the cam member, the lock pin is pressed by the rod member to clear the aperture member, the piercing member is unlocked to push toward and pierce the air canister, the pierced air canister is configured to release compressed air, and the compressed air flows to the inclined tubes to push the weights out of the tubes, thereby launching the net.

* * * * *